US007222501B2

(12) United States Patent
Cho et al.

(10) Patent No.: US 7,222,501 B2
(45) Date of Patent: May 29, 2007

(54) EVAPORATOR

(75) Inventors: Jae-Heon Cho, Chungcheongnam-do (KR); Jae-Hoon Kim, Chungcheongnam-do (KR)

(73) Assignee: Modine Korea, LLC (KR)

( * ) Notice: Subject to any disclaimer, the term of this patent is extended or adjusted under 35 U.S.C. 154(b) by 80 days.

(21) Appl. No.: 10/514,617

(22) PCT Filed: Oct. 15, 2003

(86) PCT No.: PCT/KR03/02138

§ 371 (c)(1),
(2), (4) Date: Apr. 14, 2005

(87) PCT Pub. No.: WO2004/059235

PCT Pub. Date: Jul. 15, 2004

(65) Prior Publication Data

US 2005/0172664 A1 Aug. 11, 2005

(30) Foreign Application Priority Data

Dec. 31, 2002 (KR) ..... 10-2002-0087801
Feb. 19, 2003 (KR) ..... 10-2003-0010306

(51) Int. Cl.
*F25B 39/02* (2006.01)

(52) U.S. Cl. ..... 62/515

(58) Field of Classification Search ..... 62/298, 62/515; 165/174–177
See application file for complete search history.

(56) References Cited

U.S. PATENT DOCUMENTS

| | | | | |
|---|---|---|---|---|
| 4,821,531 | A * | 4/1989 | Yamauchi et al. | 62/515 |
| 4,982,579 | A * | 1/1991 | Suzuki et al. | 62/515 |
| 5,082,051 | A * | 1/1992 | Ando | 165/110 |
| 5,172,759 | A * | 12/1992 | Shimoya et al. | 165/110 |
| 5,514,248 | A * | 5/1996 | Okuda et al. | 159/28.6 |
| 5,562,157 | A * | 10/1996 | Hasegawa et al. | 165/144 |
| 5,632,161 | A * | 5/1997 | Shimoya et al. | 62/515 |
| 6,199,401 | B1 * | 3/2001 | Haussmann | 62/525 |
| 6,581,679 | B2 * | 6/2003 | Fischer et al. | 165/174 |
| 2002/0020521 | A1 * | 2/2002 | Hoshino et al. | 165/174 |

FOREIGN PATENT DOCUMENTS

JP 6-213532 A * 8/1994

* cited by examiner

*Primary Examiner*—Mohammad M. Ali
(74) *Attorney, Agent, or Firm*—R. Neil Sudol; Henry D. Coleman; William J. Sapone

(57) ABSTRACT

The present invention relates to an evaporator for an air conditioner of a vehicle, and the major object of the present invention is to provide the evaporator which is capable of decreasing the whole dimension of an evaporator and enhancing a heat exchange performance. To achieve the above objects, an evaporator includes an upper and lower header units comprising a tank member, a partition member, a header plate, an intermediate baffle, a finishing baffle; and a plurality of tubes comprising a front tube portion, a rear tube portion, a connection tube portion; and a wrinkle fin.

22 Claims, 16 Drawing Sheets

(Standardization of Evaporator of Figure 16)

(Standardization of Evaporator of Figure 16)

(Standardization of Evaporator of Figure 16)

EVAPORATOR

TECHNICAL FIELD

The present invention relates to an evaporator for an air conditioner of a vehicle having a plurality of tube rows, and in particular to an evaporator which is capable of decreasing the whole dimension and maximizing a heat exchange efficiency in such a manner that there is provided a two-row tube structure connected between upper and lower header units of an evaporator, and a header unit, tube and wrinkle portion are improved.

BACKGROUND ART

Generally, as shown in FIG. 1, an evaporator having a plurality of tube rows includes header units 101 and 102 provided in upper and lower sides, respectively, tubes 200 provided in two rows, one row in a front side and another row in a rear side, with respect to a flow of air, and a wrinkle fin 400 provided between the tubes. In the above structure, a heat exchange is implemented between a fluid flowing therein and air flowing between the tubes.

In the improvement of the thusly constituted evaporator, it is a primary object to decrease the whole dimension and enhance a heat exchange efficiency.

The conventional two-row tube evaporator which is improved based on the above object has the following disadvantages or problems.

First, the header unit adapted to connect two-row tubes is formed of a tank member and a header plate which are fabricated by a die casting or pressing fabrication method. Therefore, the assembling productivity is decreased compared to the materials extruded, and the fabrication cost is increased.

A path space of a fluid is partitioned by inserting a baffle into the interior of the header unit. In this case, since other baffle is assembled in the front and rear spaces portioned along the two-row tubes, the assembling productivity is decreased.

In addition, when assembling the tank member and header plate of the header unit, both sides of the header plate are laterally bent in the direction of the tank member and are temporarily welded (preferably, TIG welding) and then blazing-welded. In this case, the work process is increased. A defect rate is increased due to the transformation by the temporary welding operation.

Furthermore, since the front and rear two-row tubes are separately provided, when the air which have flown between the first-row tube flows between the second-row tube, since the air is crossed, thus decreasing a ventilation.

In addition, the conventional tubes are designed to have rounded lateral sides based on its inherent fabrication property during an extrusion formation. In the above construction, a condensation water produced during a heat exchange is not easily separated, namely flows in a lateral side, thus decreasing a heat exchange efficiency.

In the conventional header unit, since the portion into which a tube is inserted is formed flat, the condensation water from the tubes do not easily flow, namely gathers by a surface tension and capillary phenomenon.

DISCLOSURE OF INVENTION

Accordingly, it is an object of the present invention to overcome the problems encountered in the conventional art.

It is another object of the present invention to provide an evaporator which is capable of decreasing the whole dimension of an evaporator and enhancing a heat exchange performance, and in detail it is possible to enhance a productivity and decrease a fabrication cost by using the elements fabricated by an extruded material and press processed material.

It is further another object of the present invention to provide an evaporator which is implemented by a direct assembling and welding operation, omitting a temporarily welding, in such a manner that a groove is formed in a tank member in a header structure, and a header plate is inserted into the groove.

It is still further another object of the present invention to provide an evaporator which is capable of enhancing a heat radiating state and decreasing a pressure loss of air by forming a connection portion between a front tube portion and a rear tube portion.

It is still further another object of the present invention to provide an evaporator which is capable of implementing an easier discharge of a condensation water through a tube gathered from a surrounding of the tube and preventing a condensation water from being gathered in the header unit and a wrinkle portion provided between the tubes from being transformed, by improving the shapes of both side ends of the tube and the shape of the header plate.

It is still further another object of the present invention to provide an evaporator which is capable of increasing a cooling effect by forming an evaporator using the upper and lower header units and tubes and forming a path structure of a refrigerant based on a certain division ratio.

To achieve the above objects, in an evaporator including upper and lower header units which each have a two-row refrigerant flow path, a plurality of tubes which connect the upper and lower header units and are formed of an aluminum material and are arranged in two rows in front and rear sides with respect to the flowing direction of air and are stack-arranged in parallel in the direction orthogonal to the flowing direction of air for flowing a refrigerant therethrough, and a wrinkle fin which is provided between the neighboring tubes for enhancing a heat transfer area of air passing through the tubes and is formed of an aluminum material, there is provided the header unit which includes a tank member having a U-shaped cross section and a vertical groove in an inner center portion in a longitudinal direction, and a groove formed in an inner surface of both side ends in a longitudinal direction; a partition member which divides an inner space of the tank member in a width-wise direction by inserting a lower side end into the vertical groove of the tank member; a header plate which is engaged between the grooves of both sides of the tank member and covers an opened portion of the tank member for sealing and has a plurality of tube holes for inserting the tubes; an intermediate baffle which is formed based on the shape of the inner portion of the tank member and partitions the inner space of the tank member; and a finishing baffle which is formed based on the shape of the inner portion of the tank member and covers the inner space for sealing when the same is assembled to both side ends of the tank member.

BRIEF DESCRIPTION OF DRAWINGS

The present invention will become better understood with reference to the accompanying drawings which are given only by way of illustration and thus are not limitative of the present invention, wherein.

BEST MODE FOR CARRYING OUT THE INVENTION

The construction and operation of the present invention will be described with reference to the accompanying drawings.

Figure 1:
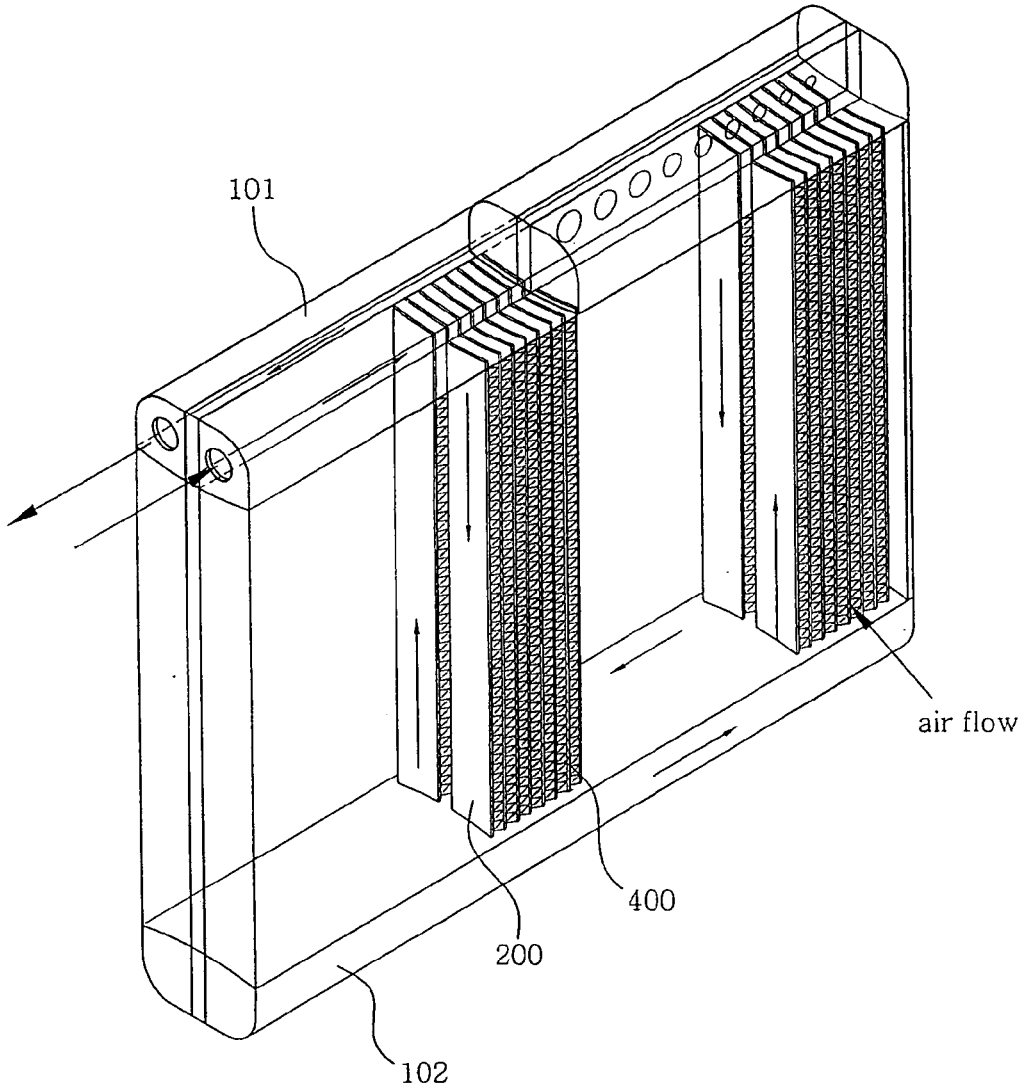
FIG. 1 is a view illustrating a conventional evaporator.
Figure 2:
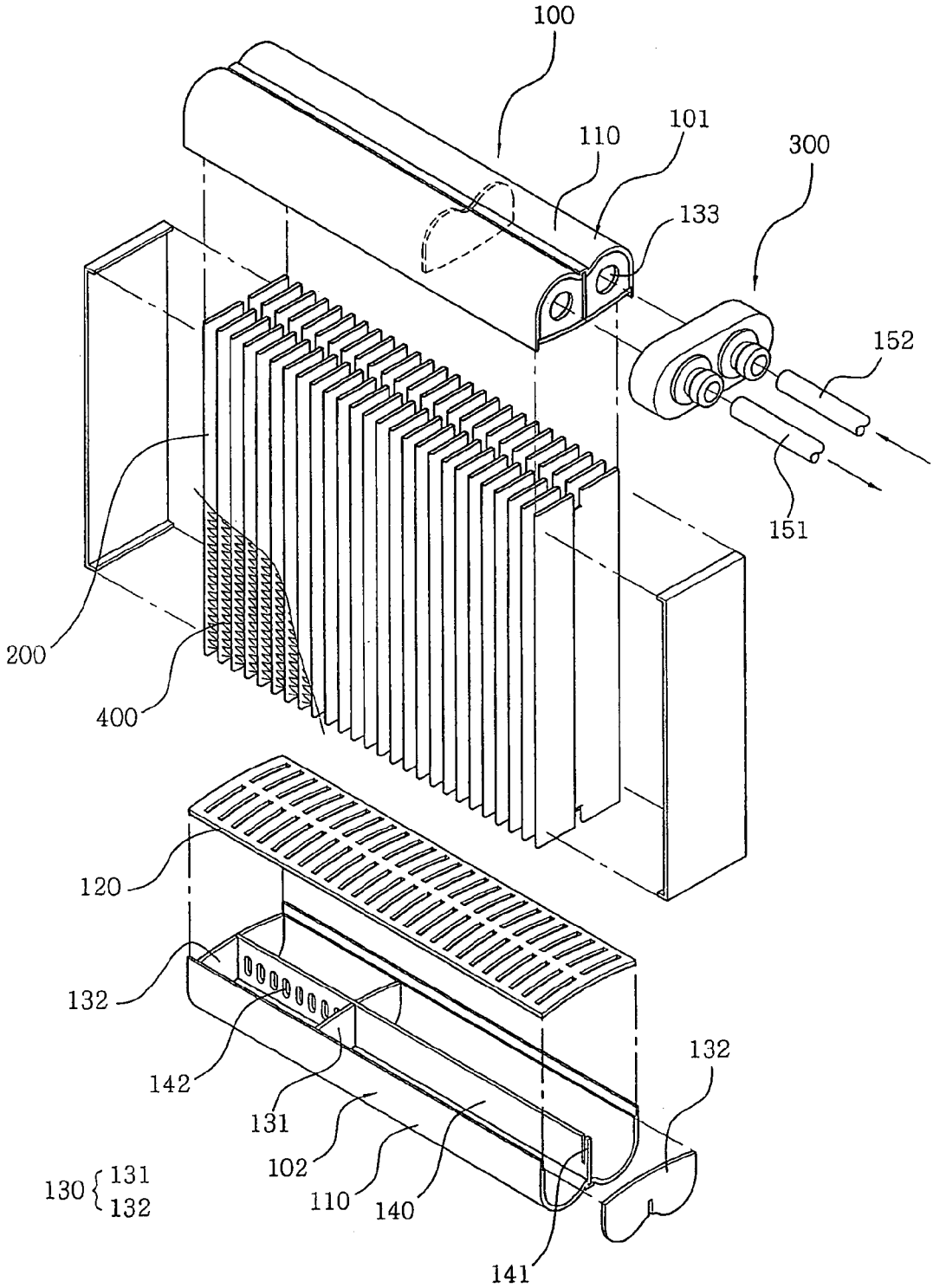
FIG. 2 is a perspective view illustrating the construction of an evaporator according to the present invention.
Figure 3:
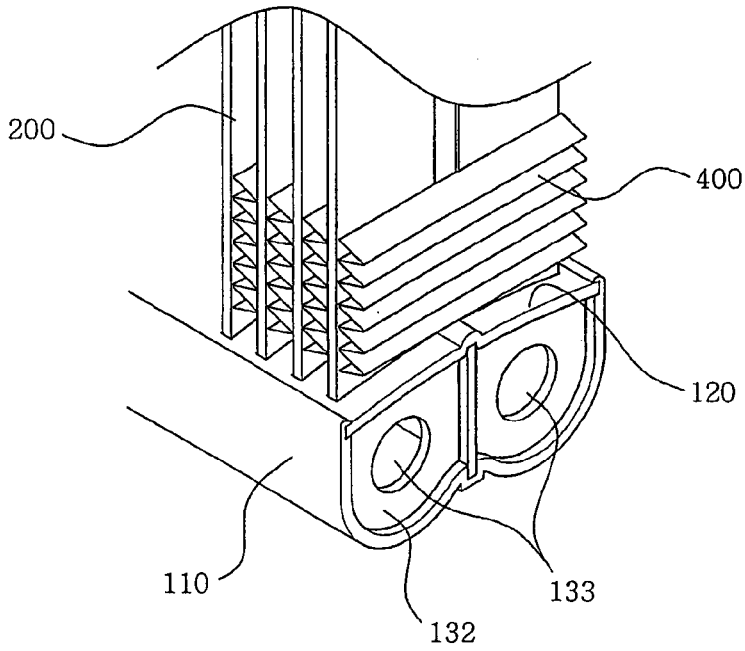
FIG. 3 is a partial perspective view illustrating an assembled state according to the present invention.

As shown in FIG. 2, an evaporator according to the present invention includes a pair of upper and lower header units 101 and 102 each having an inlet pipe 151 and an outlet pipe 152, two-row tubes 200 connecting the header units, and a wrinkle fin 400 provided between the tubes.

The header unit 100 includes a tank member 110, a header plate 120, a baffle 130, and a partition member 140.

Here, the tank member 110 is extruded to have a U shaped cross section in such a manner that width-wise both ends 111 are oriented in the same direction. If necessary, the W-shaped cross section as shown in the drawings is obtained by bending the U shaped center portion inwardly.

The header plate 120 is assembled between both side ends of the tank member for thereby sealing the inner space, and the left and right sides are close to the inner side of the both side ends. The header plate 120 has a plurality of tube holes 121.

The baffle 130: 131, 132 is formed based on the width-wise shape formed by the tank member 110 and the header plate 120, so that the inner pace is partitioned in the longitudinal direction. The partition member 140 is formed based on the length-wise shape of the inner space formed by the header unit 100 and the header plate 120, so that it is possible to partition the inner space in the width direction.

Figure 7:
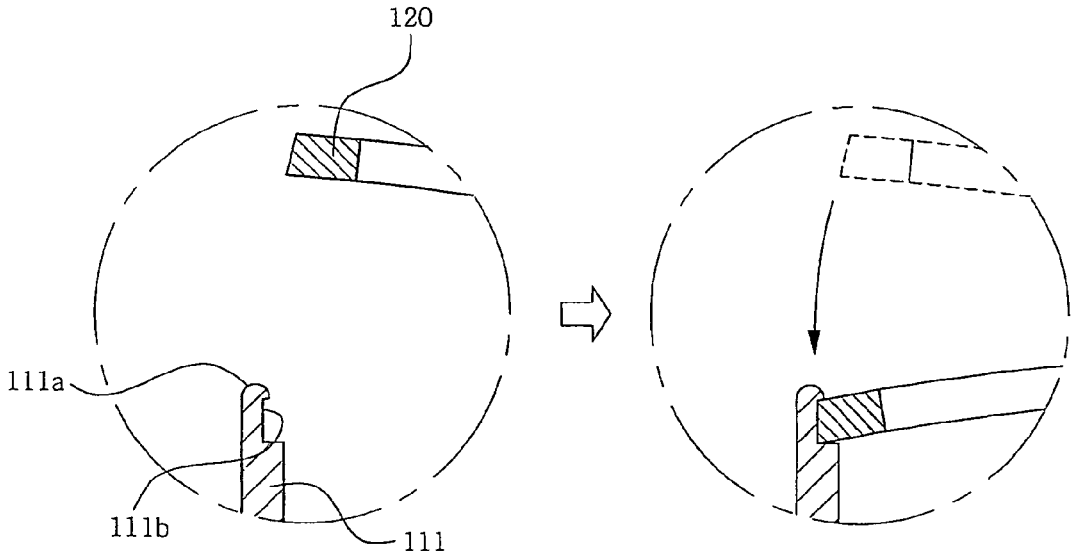
FIG. 7 is a partial cross sectional view illustrating an assembled state of FIG. 6.

At this time, as an important feature of the tank member 110 and the header plate 120 of the present invention, the tank member 110 having a U shaped cross section (or W shaped cross section as shown in the drawings) in the extrusion method, and the header plate 120 is fabricated based on the pressing method. Thereafter, as shown in FIG. 7, the width-wise both ends of the header plate 120 are fixedly inserted into the inner side of the both side ends 111 of the tank member 110 and then are blaze-welded.

The features of the tank member 110 for enhancing the assembling property will be described.

As shown in FIGS. 3 through 6, a groove 111*b* is formed in the both side ends 111 of the tank member 110 in the lengthy direction, and then the both side ends of the header plate 120 can be fixedly inserted into the groove.

Therefore, it is possible to temporarily fix the header plate 120 to the tan member 110 in the above manner. In the present invention, the conventional temporary welding is omitted by the above fixing means.

The tank member 110 has a vertical groove 112 in the center of the bottom for implementing an easier assembling of the partition member 140. The thickness portion of the partition member 140 is inserted into the vertical groove 112.

The features of the header plate 120 for enhancing the assembling property will be described.

Figure 4:
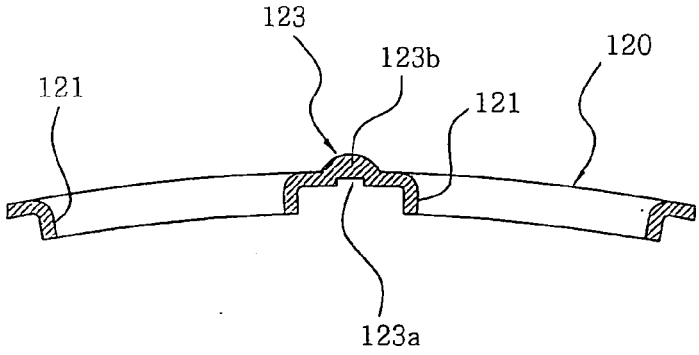
FIG. 4 is a cross sectional view illustrating a header plate according to the present invention.
Figure 5:
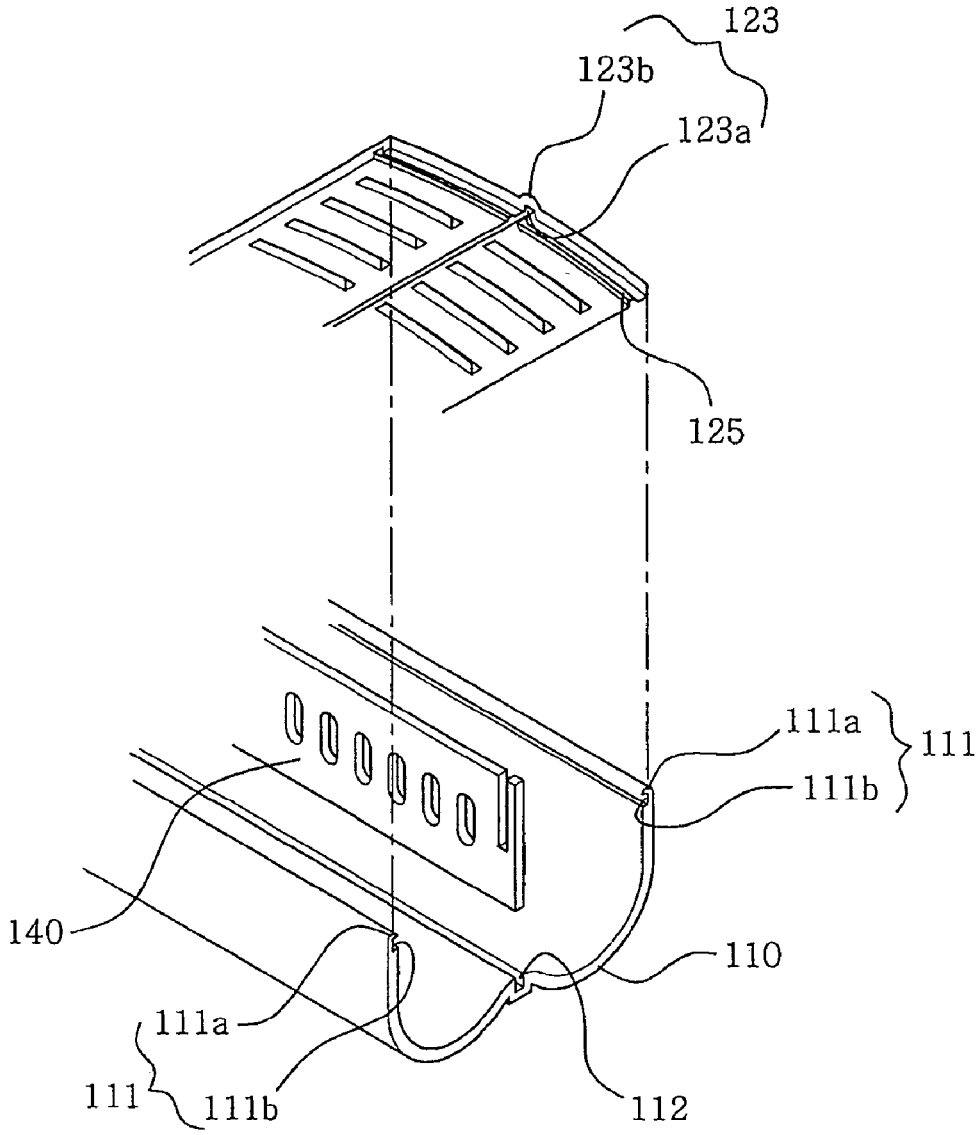
FIG. 5 is a partial perspective view illustrating a disassembled state according to the present invention.

As shown in FIG. 4, the thusly assembled header plate 120 is formed to be curved in a baffle shape for enhancing a coupling property with the tank member 110 and a ventilation performance.

Figure 6:
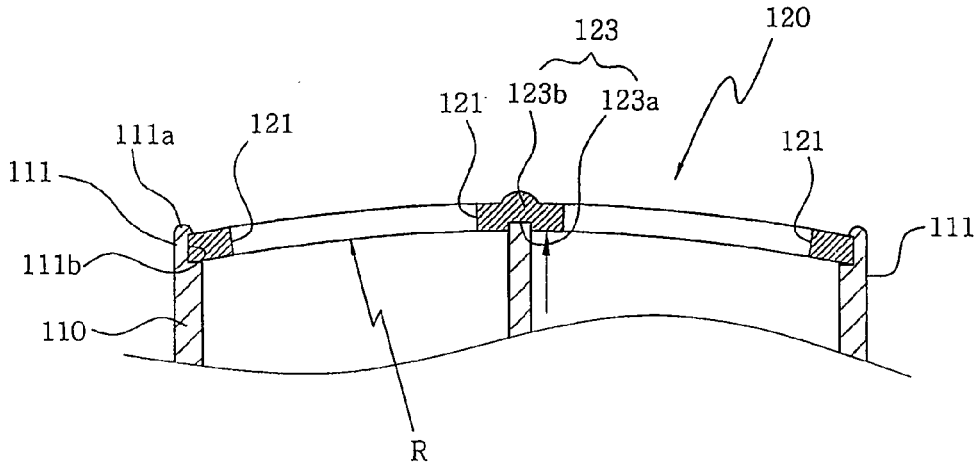
FIG. 6 is a cross sectional view illustrating the construction of a tank member according to the present invention.

As shown in FIG. 6, the curving degree is that the radius R is 75~85 mm.

Therefore, the intermediate baffle and the finishing baffle which will be described later will contact with the inner surface of the header plate. Here, the intermediate baffle and the finishing baffle each have the radius R of 75~85 mm.

Figure 19:
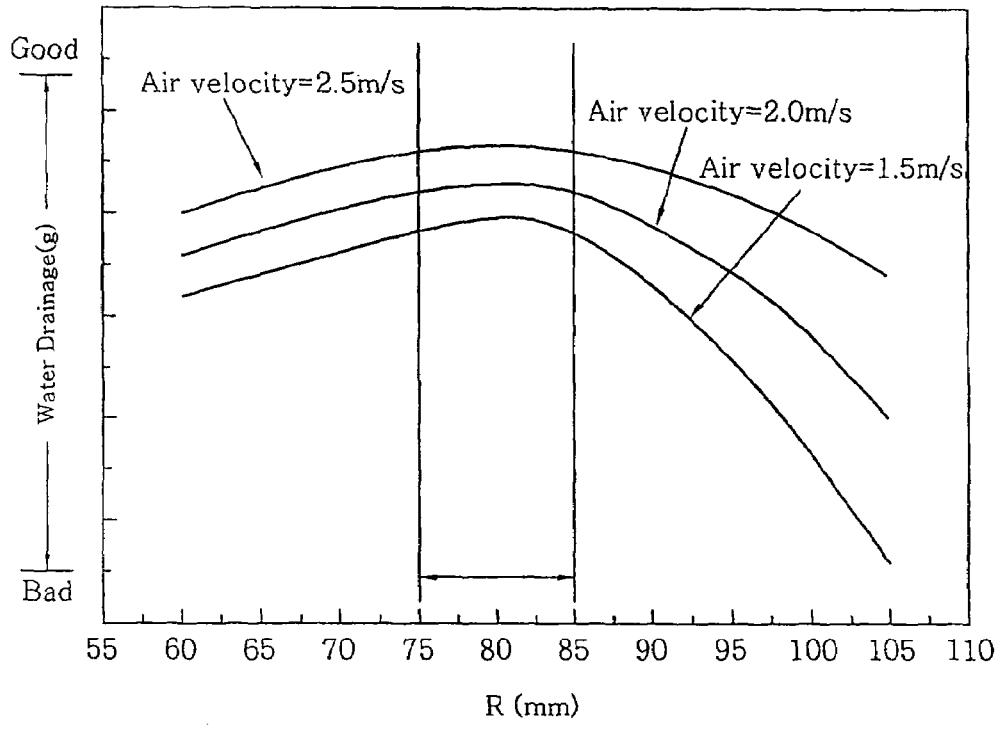
FIG. 19 is a graph of a measurement value of a radius that a header plate according to the present invention has.

The value of the radius R is determined based on the experiment of FIG. 19. Namely, when the evaporator is installed, the flowing speed of the air by a fan is changed from 2.5 m/s, 2.0 m/s, 1.5 m/s and the radius is changed from 60 mm to 105 mm, in result, it is known that the best ventilation performance is obtained when the radius R is 75~85 mm.

In addition, a bent portion 123*a* is formed in the center of the header plate 120 in the longitudinal direction, simultaneously, and a bent protrusion 123*b* is formed in the outer lateral surface. In the above construction, the lower end of the partition member 140 is inserted into the vertical groove 112 formed in the center of the bottom of the tank member 110, and the upper end of the same is inserted into the bent groove 123*a*.

A horizontal groove 125 is formed in the header plate 120 and crosses at both side ends. The upper end of the baffle 130 assembled in the both side ends of the tank member 110 is inserted into the horizontal groove 125. Therefore, the baffle 130 is not escaped to the outside of the tank member.

The features of the baffle 130 for enhancing an assembling property will be described.

As shown in FIG. 2, the baffle 130 includes more than at least one intermediate baffle 131 for partitioning the space of the interior of the header unit 100, and a pair of finishing baffles 132 for sealing the internal space at both side ends of the header unit 100.

Figure 8:
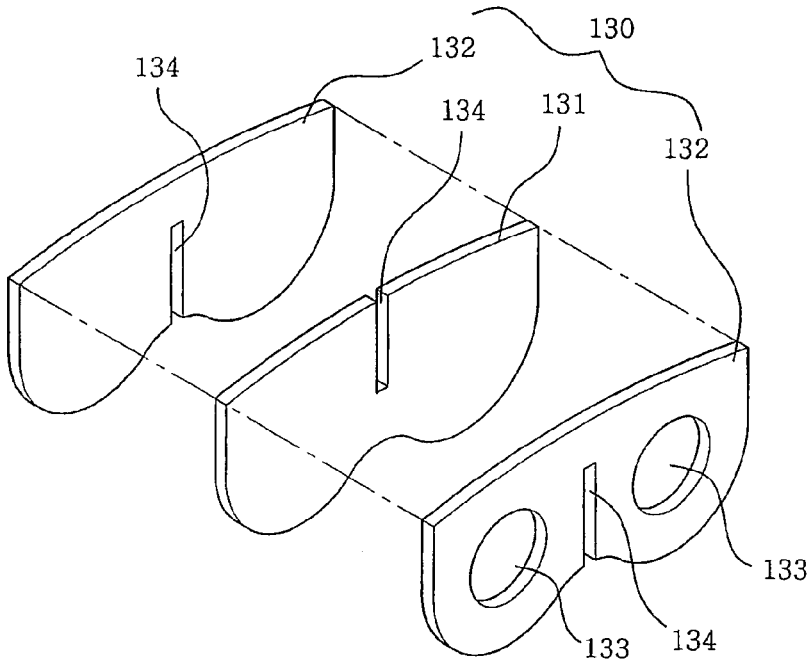
FIG. 8 is a perspective view illustrating a baffle according to the present invention.

In addition, as shown in FIG. 8, the baffles 130 may have a cut groove 134 in a certain portion for assembling with the partition member 140. One of the baffles 132 has a pair of pipe holes 133 for connecting a fluid inlet pipe 151 and a fluid outlet pipe 152.

When connecting the fluid inlet pipe 151 and the fluid outlet pipe 152 using the pipe holes 133, it is preferred to dispose the adaptor 300 of FIG. 2 for enhancing a connection convenience and sealing force.

Figure 9:
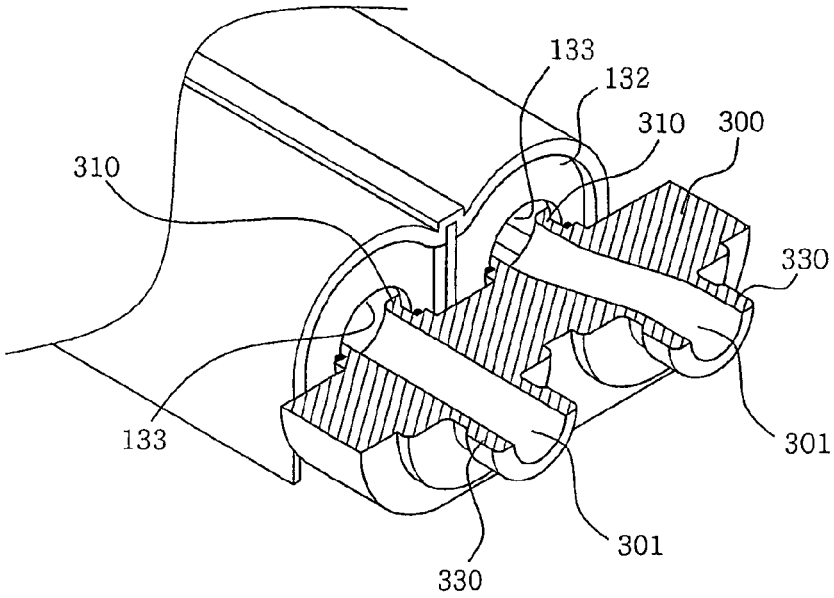
FIG. 9 is a view illustrating the construction of an adaptor according to the present invention.

As shown in FIG. 9, the adaptor 300 includes a pair of insertion pipe portions 310 inserted into the pipe hole 133 of the finishing baffle 132, a pair of connection pipe portions 330 for connecting the pipes, and a pair of trough holes 301 which pass from the insertion pipe portion 310 to the connection pipe portion 330.

Figure 10:
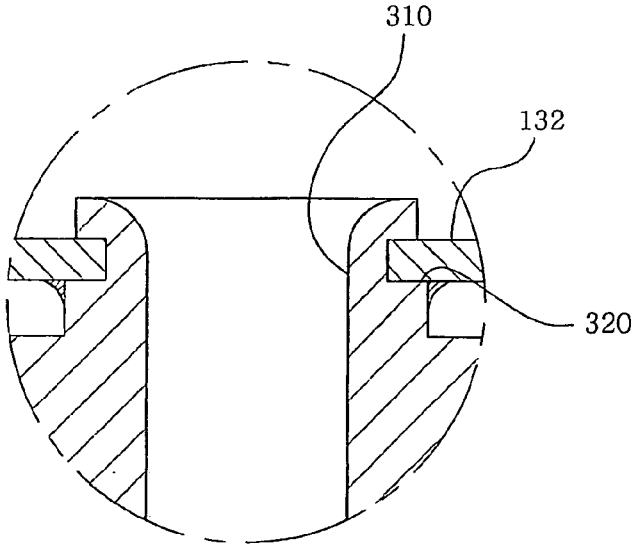
FIG. 10 is an enlarged cross sectional view of FIG. 9.

As shown in FIG. 10, when connecting the insertion pipe portion 310 of the pipe connection adaptor 300 to the finishing baffle 132, a circular rim 320 is formed in the outer diameter portion. Therefore, it is inserted into the pipe hole 133 of the finishing baffler 132 until it is stopped by the circular rim 320, and the end portion of the same is expanded and fixedly cocked.

The features of the partition member 140 for enhancing the assembling property will be described.

The tank member 110 has a partition member 140 for partitioning the inner space into two rows, namely, left and right rows.

Figure 11:
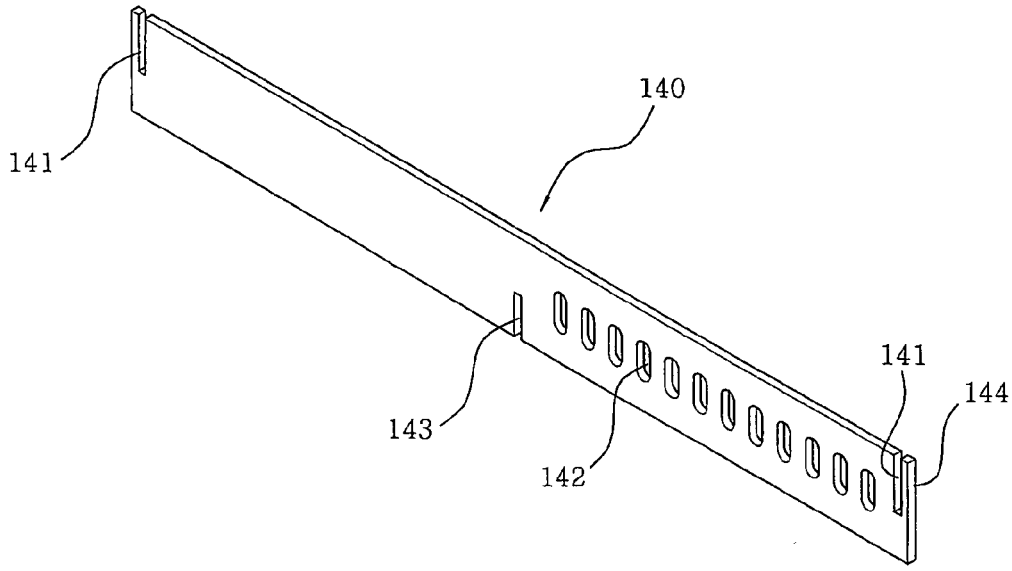
FIG. 11 is a perspective illustrating a partition member according to the present invention.

As shown in FIG. 11, the partition member 140 may include a cut groove 2(143) in an intermediate portion needed for assembling with the intermediate baffle 131. A cut groove 141 may be formed in the end portion for assembling with the finishing baffle 132.

A through hole 142 may be formed in one side of the intermediate portion for communicating the left and right spaces. The partition member 140 enhances the strength of the tank member 110 and prevents a distortion.

The features of the tube 200 according to the present invention will be described.

The tubes 200 adapted to connect the header units 101 and 102 include a front tube 210 and a rear tube 220, and a connection portion 230 for connecting the front tube 210 and the rear tube 220. The tube 200 is preferably fabricated based on the extrusion molding method for implementing a desired construction of the connection portion 230.

Figure 14:
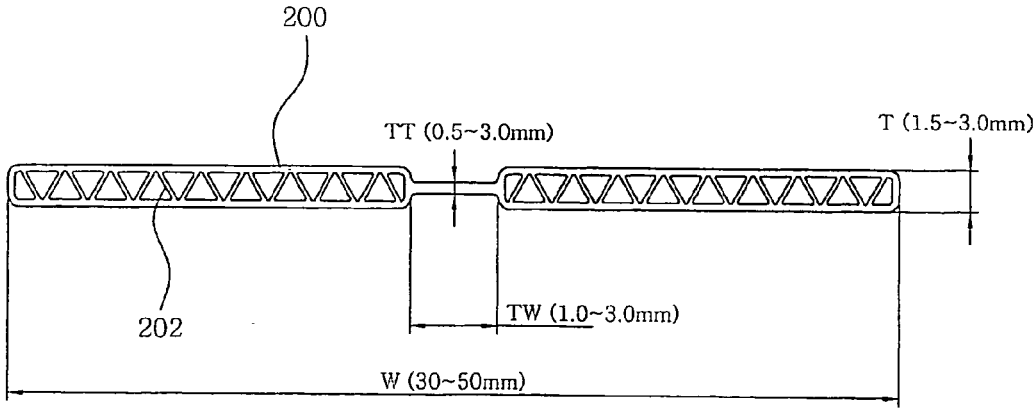
FIG. 14 is a view illustrating the construction of a tube according to further another embodiment of the present invention.

As shown in FIG. 14, the tube 200 has a width W of 30~50 mm, and a thickness T of 1.5~3.0 mm, and the connection portion 230 has a width TW of 1~3 mm, and a thickness TT of 0.5~3.0 mm.

Figure 20:
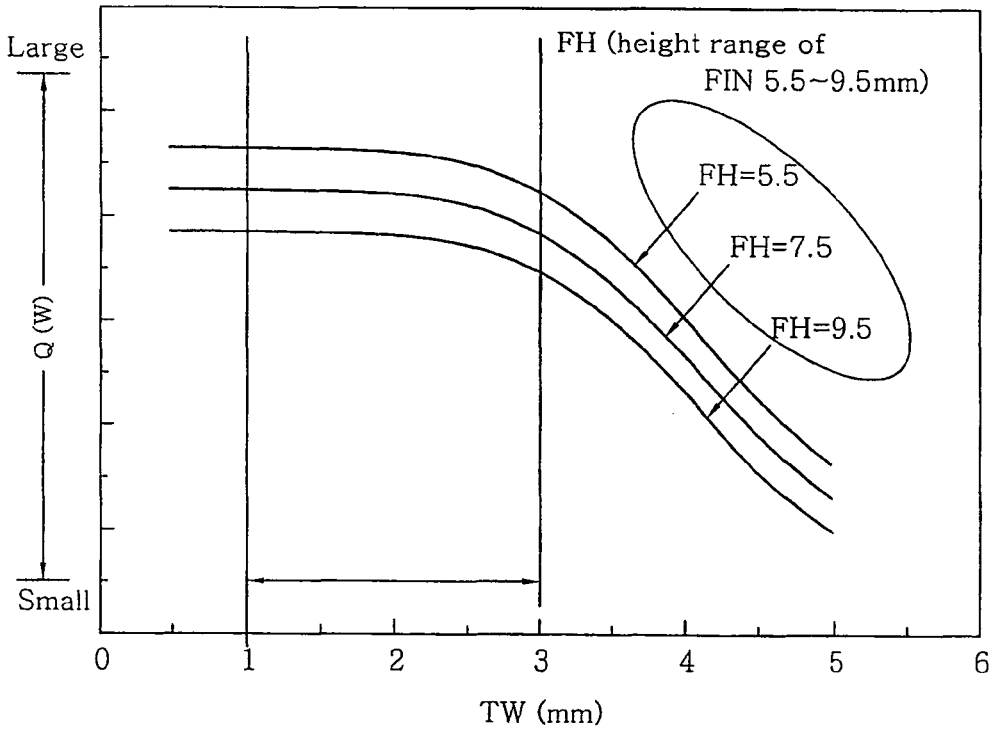
FIG. 20 is a graph of a measurement value of a heat radiating state in a connection portion of a tube according to the present invention.
Figure 21:
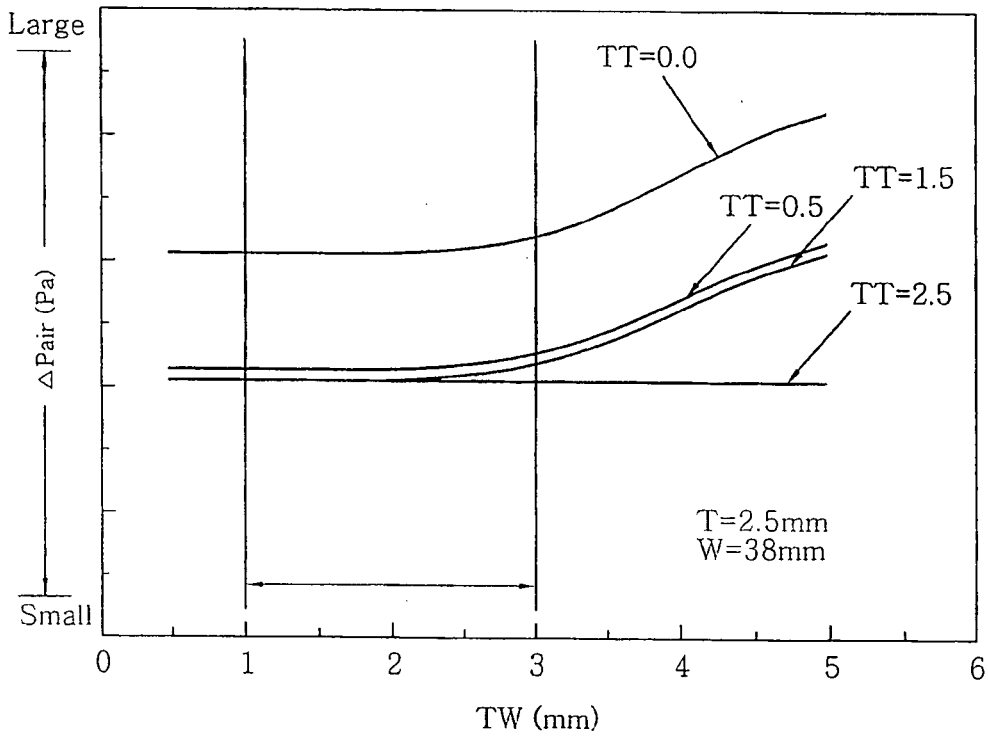
FIG. 21 is a graph of a measurement value of an air pressure loss state in a connection portion of a tube according to the present invention.

The width TW and the thickness TT of the connection portion 230 are determined based on the experiments of FIGS. 20 and 21.

Concerning the experiment of the heat radiation degree of FIG. 20, when the width TW of the connection portion was 1.0~3.0 mm, and the height of the wrinkle fin 400 was 5.5 mm, 7.5 mm, and 9.5 mm, respectively, there was less change in the heat radiation degree, and when the range of the same exceeded 3.0 mm, there was a decrease in the heat generation performance.

In addition, concerning the experiment on the air pressure loss of FIG. 21, when the width TW of the connection portion was 1.0~3.0 mm, even though the thickness TT of the connection portion 230 was changed, there were less pressure loss and change. When the range exceeded 3.0 mm, the pressure loss was increased.

When the thickness TT was 0.0 mm (there was not connection portion), it was known that there was higher pressure loss in the connection portion compared to when there was the connection portion.

When the front tube portion 210 and the rear tube portion 220 are connected and blocked using the connection portion 230, the air flowing between the optional tubes do not flow between the tubes in the next compartment, so that the flowing speed of the air is increased, and the cooling performance is increased.

In other words, since the wrinkle fins are formed between the tubes, when the air flowing between the optional tubes receives a certain resistances by the wrinkle fins, the air is guided in the lateral direction. However, in the present invention, there is the connection portion 230 between the front tube portion 210 and the rear tube portion 220, therefore, the flow of the air in the lateral direction is prevented.

Figure 12:
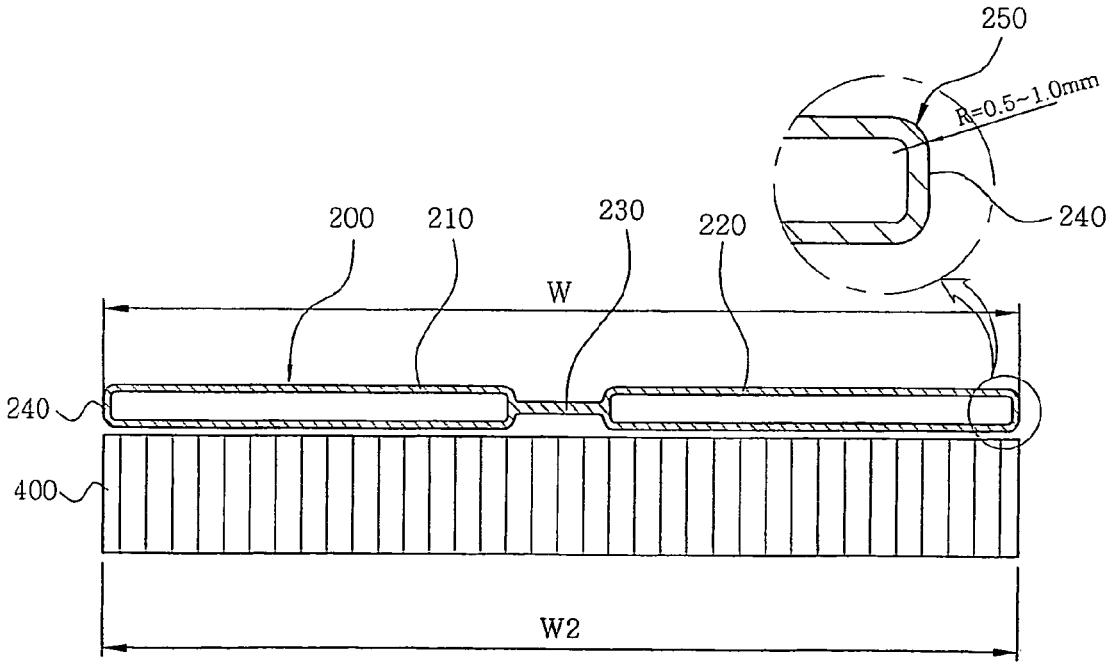
FIG. 12 is a view illustrating the construction of a tube according to the present invention.

As shown in FIG. 12, the tube 200 according to the present invention includes a plane portion 240 in the lateral outer side, and a rounding processing portion in the corner of the plane portion 240.

When the plane portion 240 is formed in the outer lateral surface of the tube 200, the air flowing in the surrounding portions of the tube makes an eddy flow in the end portion. This eddy flow prevents the condensation water from being sprayed.

Therefore, in the present invention, it is possible to prevent the condensation water from being gathered by a capillary phenomenon or surface tension force between the wrinkle fins and tubes. The condensation water directly falls at the plane portion 240 of the end portion and is discharged.

If the corners of both sides of the plane portion 240 are too angled, the angled portions may cause an eddy flow and prevents the flow of air. Therefore, it is needed to have the rounding processing portion 250 having a certain rounding degree. At this time, the radius R of the rounding curvature of the rounding processing portion 250 is preferably in a range of 0.5 mm~1.0 mm.

The radius of 0.5 mm~1.0 mm is related to the brazing welding of the wrinkle fin 400 formed between the tubes 200.

Namely, when the wrinkle fins between the tubes are brazing-welded, if the radius is too large, the end of the wrinkle fin 400 does not contact with the tube. Therefore, even when a clad material is melted during the brazing welding, the welding is not performed up to the end portion. If the radius is too small, the eddy flow is too increased in the flow of air.

According to the experiment performed in consideration with the above matter, the radius of the rounding curvature is preferably in a range of 0.5 mm~1.0 mm.

Figure 13:
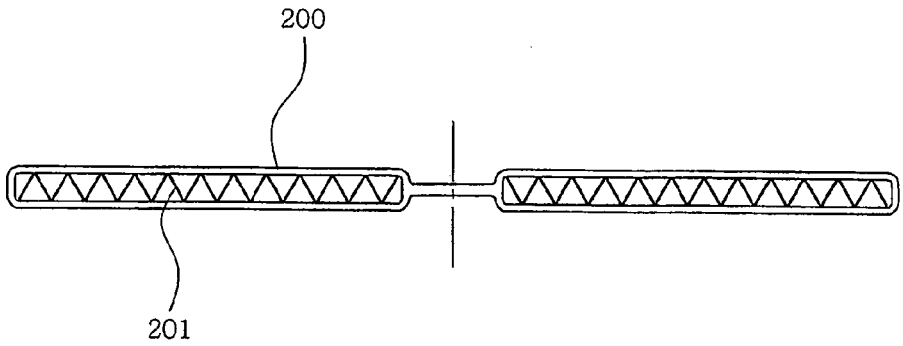
FIG. 13 is a view illustrating the construction of a tube according to another embodiment of the present invention.

As shown in FIG. 13, the tube 200 may include an inner fin 201 which divides the inner space into a plurality of spaces and may integrally include a plurality of partition plates 202 which divide the inner space into a plurality of spaces as shown in FIG. 14.

The inner fin 201 and the partition plate 202 are adapted to increase the heat exchange efficiency.

In addition, as shown in FIG. 14, the partition plate 202 is installed at an inclined angle, so that the refrigerant flow paths preferably have a triangle shape and an inverted triangle shape repeatedly in sequence in their cross sections.

As shown in FIG. 12, the wrinkle fin 400 of the present invention has the same width 2(W2) as the width W of the tube 200.

Namely, in the conventional art, when the width W of the tube and the width 2(W2) of the wrinkle fin 400 are same, the wrinkle fin is pressed and distorted, so that the ventilation is decreased. However, in the present invention, since the ends of the tubes are formed of the plane portions 240, the wrinkle fin 400 is not pressed, so that the ventilation is not decreased.

The embodiments of the evaporator fabricated using the above elements according to the present invention will be described.

[Embodiment 1]

Figure 15:
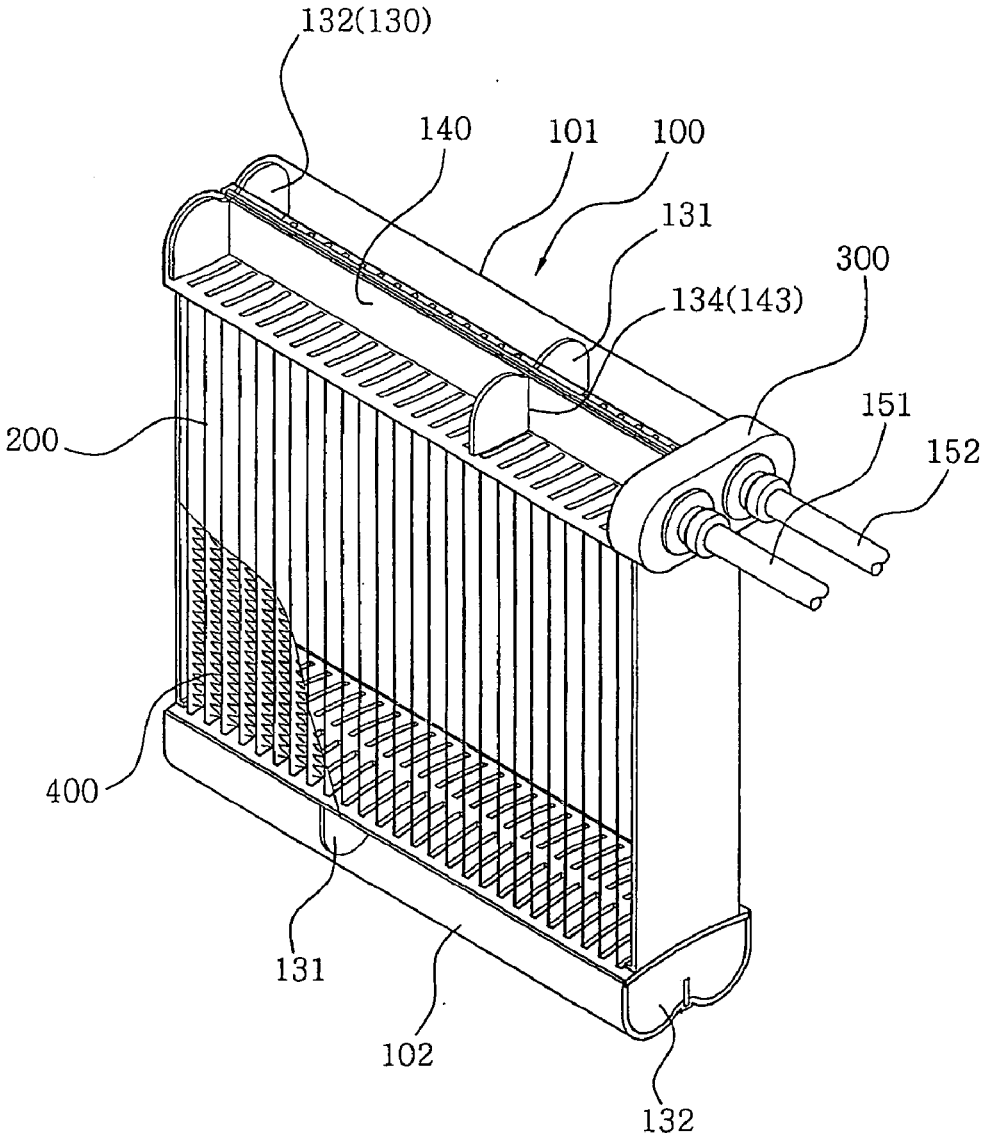
FIG. 15 is a view illustrating the construction according to a first embodiment of the present invention.

As shown in FIG. 15, the embodiment 1 of the present invention is implemented based on the above described elements as a basic type.

Namely, there are provided upper and lower header units 101 and 102, a two-row tube 200 connecting the header units, and a wrinkle fin 400 provided between the tubes. As described above, the upper side header unit 101 connects a refrigerant inlet pipe 151 and a refrigerant outlet pipe 152 using the adaptor 300 in one side finishing baffle 132.

The interior of the upper header unit 101 is divided by the partition member 140 which is assembled in the longitudinal direction and divides the width-wise portion, and the intermediate baffle 131 which is engaged with the partition member 140 and the cut groove 143 and divides the left and right lengths at about ⅓ distance of the right side in the drawing.

The interior of the lower side header unit 102 is divided by the partition member 140 which is assembled in the longitudinal direction and divides the width wise portion, and the intermediate baffle 131 which is engaged with the partition member 140 and the cut groove 143 and divides the left and right lengths at about ⅓ distance of the left side in the drawing.

At this time, it is preferable to perform the blazing welding by coating a blazing welding clad material on both sides of the partition member, intermediate baffle, finishing baffle and header plate except for the portions of the tank member before blazing-welding the header units for thereby saving the clad materials.

Figure 16:
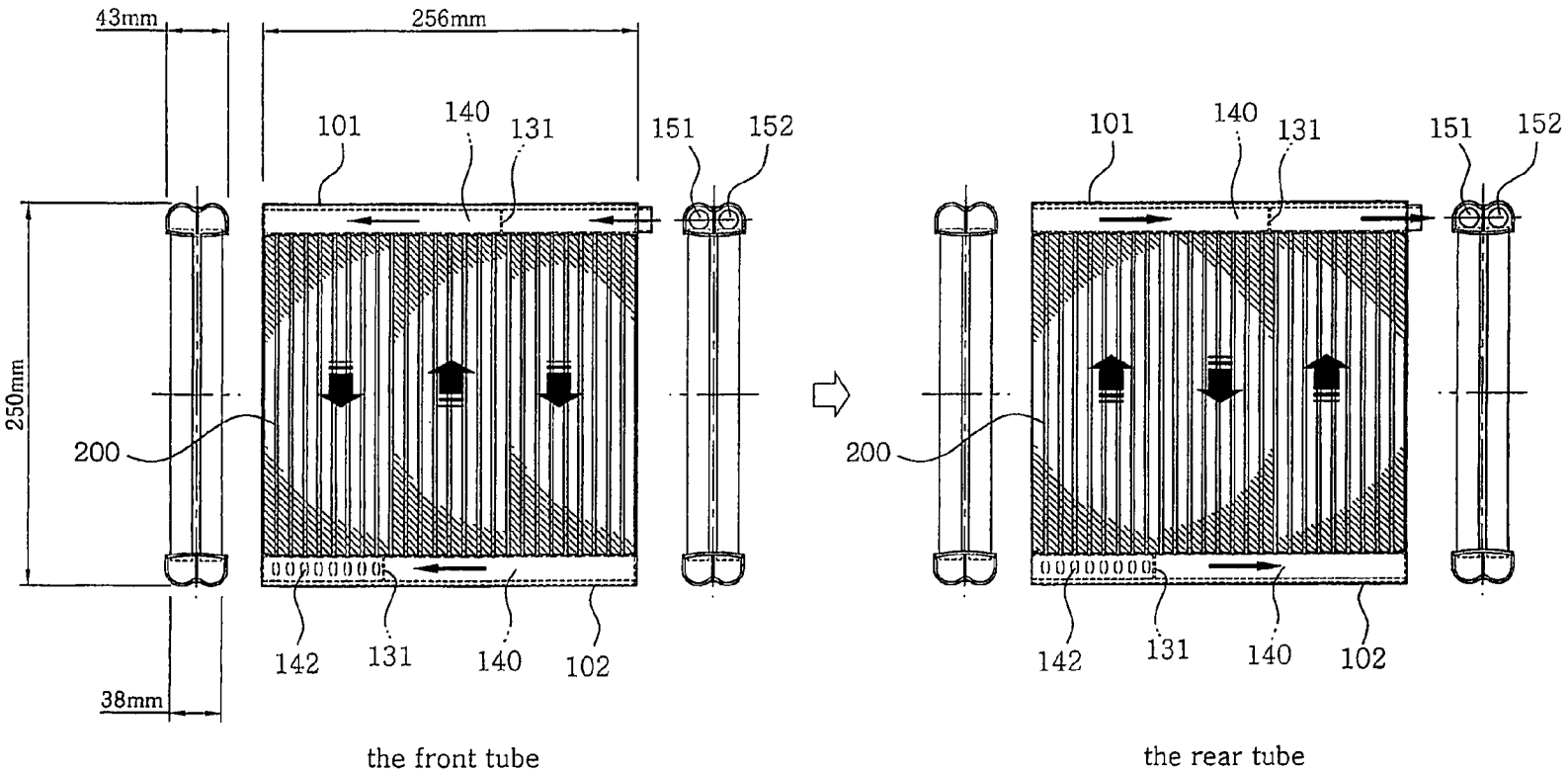
FIG. 16 is a view of a description of a path according to a first embodiment of the present invention.

The use of the evaporator according to the first embodiment of the present invention will be described. As shown in FIG. 16, the refrigerant flown into the insertion pipe portion 310 of the adaptor 300 flows in the following sequence.

Namely, the refrigerant is moved to the front right space of the upper header unit 101. Since there is the intermediate baffle 131, the refrigerant flows downwardly along the front side tube 210 and then flows to the center portion in the front right side of the lower header unit 102 and flows to the upper side along the front tube 200. Thereafter, the refrigerant flows into the left space in the front center portion of the header unit 101 and flows to the front left portion of the lower header unit 102 along the front tube 210.

The refrigerant flows to the rear side of the lower header unit 102 through the through hole 142 formed in the partition member 140 of the lower header unit 102.

In the rear header unit 100, since there is the intermediate baffle 131, the refrigerant flows upwardly along the rear tube 220, and in the rear side of the upper header unit 101, the refrigerant flows to the center portion and flows to the rear side of the lower header unit 102 along the rear tube 220.

In addition, in the rear side of the lower header unit 102, the refrigerant flows to the right side and moves up along the rear tube 220 and is discharged to the outside though the connection pipe portion 330 of the adaptor 300 in the rear side of the upper header unit 101.

As shown in FIG. 16, according to the above flow paths, since the heating distributions of the refrigerant flowing through the front tube 210 and the rear tube 220 are different, the cooling effect is enhanced.

[Embodiment 2]

Figure 17:
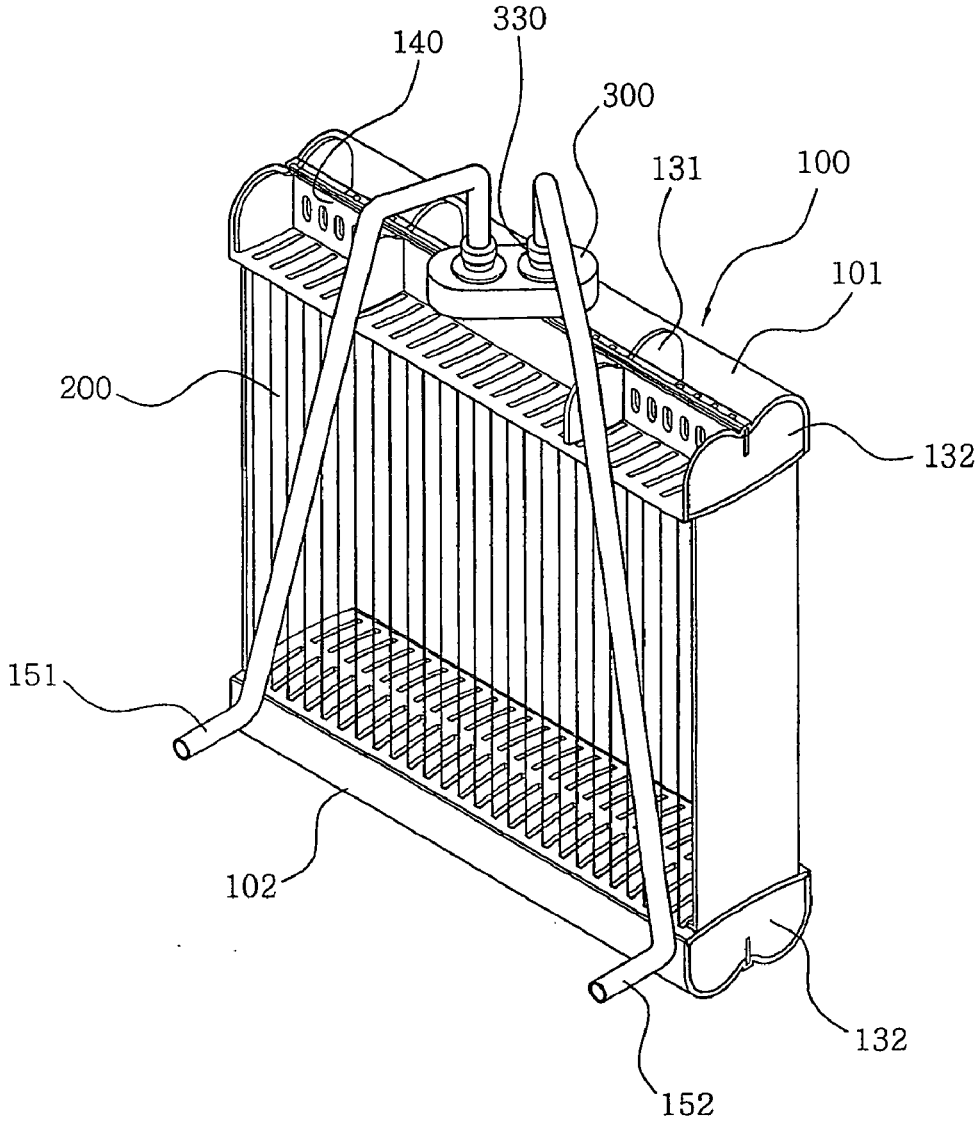
FIG. 17 is a view illustrating the construction according to a second embodiment of the present invention.

FIG. 17 is a view illustrating the paths structure according to the second embodiment of the present invention.

As shown in FIG. 17, the adaptor 300 is connected to an intermediate portion of the upper header unit 101. There are provided upper and lower header units 101 and 102, a two-row tube 200 connecting the header units, and a wrinkle fin 400 provided between the tubes. The upper and lower header units 101 and 102 are sealed using the finishing baffle 132.

The interior of the upper header unit 101 is divided by a partition member 140 which is assembled in the longitudinal direction and divides the front and rear width portions, and an intermediate baffle 131 which is assembled to be engaged with the partition member 140 and the cut groove 143 and divides the left side portion by ½ or divides the right side portion by ½. In the interior of the lower header unit 102, there is only the partition member 140 which is assembled in the longitudinal direction and divides the front and rear width portions. There is not formed an intermediate baffle in the interior of the lower header unit 102.

Figure 18:
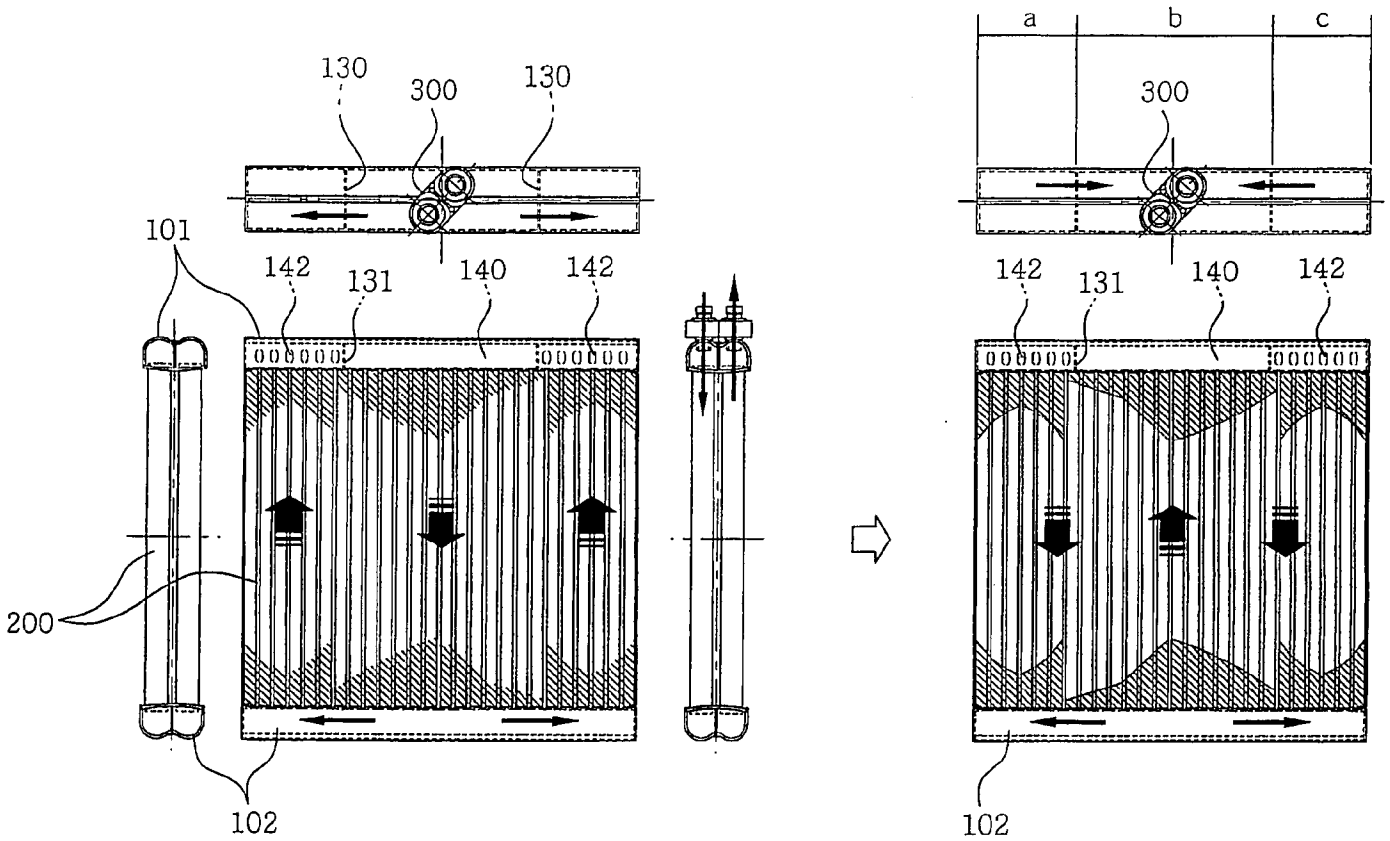
FIG. 18 is a view of a description of a path according to a second embodiment of the present invention.

As shown in FIG. 18, the refrigerant from the insertion inlet pipe 310 of the adaptor 300 flows in the following sequences.

Namely, the refrigerant flown into the center portion of the upper header unit 101 flows to the lower header unit 102 along the front tube 210 by the intermediate baffle 131 assembled in the left and right sides. In the front side of the lower header unit 102, the refrigerant are spread in left and right sides and then is moved up along the front tube 210.

In the upper header unit 101, since the refrigerant flows to the outer side of the intermediate baffle 131 assembled in the left and right sides, the refrigerant is moved to the rear side of the upper header unit 101 along the through hole 142 formed in each partition member 140.

In the rear side of the upper header unit 101, the refrigerant moves down at the left and right sides along both sides of the rear tube 220 and is gathered at the center portion in the rear side of the lower header portion 102 and is moved up along the center portion of the rear tube 220.

Therefore, the refrigerant moved up to the center of the upper header unit 101 is discharged to the outside along the connection pipe portion 330 in the sufficient heat-exchanged state.

The above described path flow is preferred when the refrigerant inlet pipe and the refrigerant outlet pipe are positioned in the center portion. The inner space of the upper header unit 101 is divided into the space a in the left side, the space b in the center and the space c in the right side by two intermediate baffles 131. The volumes of the spaces a, b, and c are preferably 20:60:20, not 25:50:25.

Namely, the above ratios correspond to the values that the number of the tubes connected between the upper and lower header units 101 and 102 is divided into the center, right and center, so that the initial refrigerant flowing to the center portion performs much heat exchange. In addition, when the refrigerant is moved to the left and right sides, the heat exchange is performed, and then the volume is gradually decreased. Therefore, the ratios of the space a, b and c are most preferably 20:60:20 with respect to the length of the header unit.

As described above, in the evaporator according to the present invention, the tank member and header plate which are the elements of the header unit are formed of the extruded materials and processing processed materials, so that it is possible to enhance the productivity and decrease the fabrication cost.

In particular, in the present invention, when forming a two-row tube, the front tube and the rear tube are integrally connected using the connection portion, so that the air flowing between the tubes is not flown over to other tubes for thereby enhancing a head exchange efficiency.

In addition, since the ends of the tube are formed in plane, the condensation water gathered from the surrounding is effectively discharged along the tube. The wrinkle fin provided between the tubes is not easily transformed.

In the present invention, it is possible to adjust the number of the tubes for implementing a smooth flow of refrigerant by adjusting the position of the intermediate baffle. The assembling intervals of the tubes arranged in two rows may be determined so that the air is gathered at a portion in which the air intensively flow, thus enhancing the cooling performance.

Therefore, in the present invention, the heat exchange is enhanced by improving the structures, so that the whole dimension of the evaporator is decreased without decreasing the heat exchange capability. The tank member and header plate of the header unit have a certain elastic fixing force, so that a temporarily welding is omitted, and a direct assembling and blazing welding are implemented for thereby significantly enhancing the productivity.

The present invention is not limited to the above embodiment. As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. In an evaporator including upper and lower header units which each have a two-row refrigerant flow path, a plurality of tubes which connect the upper and lower header units and are formed of an aluminum material and are arranged in two rows in front and rear sides with respect to the flowing direction of air and are stack-arranged in parallel in the direction orthogonal to the flowing direction of air for flowing a refrigerant therethrough, and a wrinkle fin which is provided between the neighboring tubes for enhancing a heat transfer area of air passing through the tubes and is formed of an aluminum material, a header unit of an evaporator, comprising:

a tank member which has a U-shaped cross section and has a vertical groove in an inner center portion in a longitudinal direction, and has a groove formed in an inner surface of both side ends in a longitudinal direction;

a partition member which divides an inner space of the tank member in a width-wise direction by inserting a lower side end into the vertical groove of the tank member;

a header plate which is engaged between the grooves of both sides of the tank member and covers an opened portion of the tank member for sealing and has a plurality of tube holes for inserting the tubes;

an intermediate baffle which is formed based on the shape of the inner portion of the tank member and partitions the inner space of the tank member; and a finishing baffle which is formed based on the shape of the inner portion of the tank member and covers the inner space for sealing when the same is assembled to both side ends of the tank member.

2. The evaporator of claim 1, wherein said tank member includes a rounding portion in an upper side of the groove in order to easily press and insert the header plate from an upper direction.

3. The evaporator of claim 1, wherein said tank member has a W shaped cross section formed in such a manner that the center portion corresponding to the vertical groove is inwardly bent.

4. The evaporator of claim 1, wherein said partition member includes a through hole at a certain portion at least for connecting the inner spaces of the tank member which are divided in the width-wise direction.

5. The evaporator of claim 1, wherein said partition member includes a cut groove at an intermediate portion of its length for assembling the intermediate baffle and another cut groove at both side ends for assembling a finishing baffle.

6. The evaporator of claim 1, wherein said header plate is formed to have a center expanded in a circular shape and has a radius R of 75~85 mm.

7. The evaporator of claim 1, wherein said header plate has a bent portion in a center portion in the longitudinal direction, a bent protrusion in the outer side surface, and a bent groove in an inner surface for guiding the assembling of the partition member.

8. The evaporator of claim 1, wherein said header plate includes a horizontal groove which crosses the width at both side ends for guiding the assembling of the finishing baffle.

9. The evaporator of claim 1, wherein said intermediate baffle and finishing baffle each have a curvature in a portion contacting with the header plate, said curvature having a radius R of 75~85 mm.

10. The evaporator of claim 1, wherein said intermediate baffle and finishing baffle each have a cut groove at a center portion for assembling the partition member.

11. The evaporator of claim 1, wherein said finishing baffle assembled to both side ends of the tank member has refrigerant inlet and outlet pipe holes in one finishing baffle.

12. The evaporator of claim 1, wherein in said header unit, a blazing welding clad material is coated on both sides of a partition member, intermediate baffle, finishing baffle, and header plate except for the portions of the tank member before blazing-welding is performed.

13. The evaporator of claim 1, wherein the inner space of the upper header unit is divided into the spaces a, b and c using the intermediate baffle based on the dividing ratios of 20:60:20 with respect to the whole length, and refrigerant inlet and outlet are formed in the space b.

14. The evaporator of claim 13, wherein the inner space of said upper header unit is divided in the width-wise direction using the partition member, and a through hole is formed in the spaces a and c.

15. In an evaporator including upper and lower header units which each have a two-row refrigerant flow path, a plurality of tubes which connect the upper and lower header units and are formed of an aluminum material and are arranged in two rows in front and rear sides with respect to the flowing direction of air and are stack-arranged in parallel in the direction orthogonal to the flowing direction of air for flowing a refrigerant therethrough, and a wrinkle fin which is provided between the neighboring tubes for enhancing a heat transfer area of air passing through the tubes and is formed of an aluminum material, an evaporator which is characterized in that the tube is formed of front row tubes and rear row tubes having a plurality of partitions for thereby forming a plurality of refrigerant flow paths therein, and a connection portion connects the tubes, and the connection portion has a width TW of 1~3 mm, and a thickness TT of 0.5~3.0 mm.

16. The evaporator of claim 15, wherein the whole width W of the tube including the front row tubes and rear row tubes and the connection portion connecting the tubes is 30~50 mm.

17. The evaporator of claim 15, wherein the thickness T of said tube is 1.5~3.0 mm.

18. The evaporator of claim 15, wherein the width-wise outer surface of said tube has a plane portion orthogonal with respect to a thickness-wise portion, and a rounding processed portion formed in the corner of the plane has a radius of about 0.5~1.0 mm.

19. The evaporator of claim 15, wherein said wrinkle fin has the same width W2 as the with W of the tube.

20. The evaporator of claim 15, wherein in said tube, the front row tubes and rear row tubes and the connection portion connecting the tubes are integrally formed by an extrusion molding method.

21. The evaporator of claim 15, wherein said tube has a plurality of refrigerant flowing paths therein, and each refrigerant flowing path has a cross section of a triangle shape and inverted triangle shape.

22. The evaporator of claim 16, wherein the thickness T of said tube is 1.5~3.0 mm.

* * * * *